US007328970B2

(12) United States Patent
Mihara et al.

(10) Patent No.: US 7,328,970 B2
(45) Date of Patent: Feb. 12, 2008

(54) RECORDING HEAD AND IMAGE RECORDING DEVICE

(75) Inventors: Tohru Mihara, Kanagawa (JP); Kota Nakayama, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 305 days.

(21) Appl. No.: 11/059,515

(22) Filed: Feb. 17, 2005

(65) Prior Publication Data

US 2005/0179738 A1 Aug. 18, 2005

(30) Foreign Application Priority Data

Feb. 18, 2004 (JP) ..... 2004-041448

(51) Int. Cl.
*B41J 2/145* (2006.01)
*B41J 2/15* (2006.01)

(52) U.S. Cl. ..... 347/40; 347/59

(58) Field of Classification Search ..... 347/10, 347/57, 40, 59
See application file for complete search history.

(56) References Cited

U.S. PATENT DOCUMENTS 5,081,474 A * 1/1992 Shibata et al. ..... 347/59
5,821,953 A * 10/1998 Nakano et al. ..... 347/10
6,149,263 A * 11/2000 Nakano ..... 347/43

FOREIGN PATENT DOCUMENTS

JP 03-224741 10/1991

* cited by examiner

*Primary Examiner*—Thinh Nguyen
(74) *Attorney, Agent, or Firm*—Morgan, Lewis & Bockius LLP

(57) ABSTRACT

A recording head includes: liquid discharge ports that discharge liquid and are arranged at a pitch corresponding to a resolution, wherein said liquid including an ink; plural drive elements that cause the liquid to be discharged from the liquid discharge ports in correspondence to the liquid discharge ports and are arranged at a pitch corresponding to the resolution; and plural drivers having voltage buffer regions for buffering effects resulting from a high voltage, said drivers being serially connected in a one-to-one ratio to, and unitized with, the drive elements, and being arranged at a pitch enlarged by at least the voltage buffer region portions with respect to the pitch of the drive elements, and driving the drive elements.

15 Claims, 7 Drawing Sheets

RECORDING HEAD AND IMAGE RECORDING DEVICE

CROSS-REFERENCE TO RELATED APPLICATION

This application claims priority under 35 USC 119 from Japanese Patent Application No. 2004-041448, the disclosure of which is incorporated by reference herein.

BACKGROUND OF THE INVENTION

1. Field of the Invention

The present invention relates to a recording head and an image recording device. In particular, the present invention relates to a recording head and an image recording device configured by liquid discharge ports that discharge liquid being arranged at a pitch corresponding to a resolution and plural drive elements for causing the liquid to be discharged from the liquid discharge ports in correspondence to the liquid discharge ports being arranged at a pitch corresponding to the resolution. Note that, in the present invention, "liquid" includes ink and a treatment liquid that agglomerates color materials which are included in the ink.

2. Description of the Related Art

In recent years, in image recording devices, in accompaniment with increases in the speed of image recording, there has been an increase in the print width as the result of an increase in the number of nozzles for discharging liquid disposed in a recording head used in an inkjet printer.

For example, in so-called thermal inkjet recording heads that heat the liquid and cause the liquid to be discharged from nozzles, as shown in FIG. 6A, low-resistance heaters 140 that heat the liquid and driver transistors 142 for driving the heaters 140 are disposed one apiece with respect to one nozzle. By switching the driver transistors 142 ON and OFF, a low voltage/large current is applied to the heaters 140 and the heaters 140 are driven.

In FIG. 6A, each heater 140 is connected to a line 150 to which a voltage is applied from both ends, and source terminals of the drive transistors 142 are grounded via a line 160.

In order to increase the speed of image recording without causing the image quality to deteriorate, it is necessary for the number and disposed pitch of the nozzles disposed in the recording head to correspond to the resolution of the printer. For this reason, there are instances where 600 to 800 nozzles are disposed per inch, and the miniaturization of elements configuring the recording head is progressing. Usually, each element is formed by a Large Scale Integration (LSI) process.

It is also necessary for the disposed pitch of the heaters to be the same as the disposed pitch of the nozzles, but the disposed pitch of the driver transistors is determined in accordance with the design rule of the LSI process. For this reason, it is common to make the disposed pitch of the driver transistors the same as or less than the disposed pitch of the heaters.

However, when the disposed pitch of the driver transistors is made the same as or less than the disposed pitch of the heaters, the potential differences at both ends of the heaters connected in parallel to the heater power supply exhibit a tendency to be larger towards the heaters at both ends and smaller towards the central heater, as shown in FIG. 7. This tendency becomes more pronounced as the number of heaters connected in parallel increases.

Namely, this results from wiring resistances that arise due to differences in the distances (i.e., wiring lengths) between the heaters 140 and the heater power supply. In FIG. 6B, an equivalent circuit of FIG. 6A is shown. As shown in FIG. 6B, there are wiring resistances in the conductors that electrically connect the heaters 140 to a common power supply. This is because the size of the wiring resistance is different between the heaters connected at both ends and the heater connected in the center.

The current flowing in the recording head increases as the result of an increase in the number of nozzles disposed in the recording head. For this reason, technology has been proposed to raise the withstand voltage of the entire drive system, raise the drive voltage of the recording head and lower the current. Particularly with respect to the driver transistors, it is preferable to raise the withstand voltage without raising the ON resistance.

Conventionally, as technology that can be applied in order to raise the withstand voltage without raising the ON resistance of the transistors, it has been proposed to dispose, in a MOS transistor array that drives electrothermal conversion elements connected in a matrix, channels of a type different from the source regions as voltage buffer regions so as to surround the source regions in order to raise the withstand voltage without raising the ON resistance (see Japanese Patent Application Laid-Open (JP-A) No. 03-224741).

However, in a recording head configured as described above, when voltage buffer regions are simply disposed in the source regions as proposed in JP-A No. 03-224741, the transistors become large as a result, and the conventional disposed pitch cannot be applied as is.

Also, nothing can be solved with respect to differences in the wiring resistance, and depending on the layout, the differences in the wiring resistances end up increasing.

Namely, when laying out units configured by heaters and transistors, there is usually no concern to enlarge only the disposed pitch of the drivers. Even in JP-A No. 03-224741, there is no description in regard to technology relating to the layout between the transistors and the electrothermal conversion elements in consideration of the wiring resistance.

SUMMARY OF THE INVENTION

The present invention has been made in order to address the above circumstances and provides a recording head and an image recording device that can conduct image recording at a high speed while alleviating effects resulting from differences in wiring resistance between units configured by drive elements and transistors and lowering the drive current.

A first aspect of the invention provides a recording head including: liquid discharge ports that discharge liquid and are arranged at a pitch corresponding to a resolution, wherein said liquid including an ink; plural drive elements that cause the liquid to be discharged from the liquid discharge ports in correspondence to the liquid discharge ports and are arranged at a pitch corresponding to the resolution; and plural drivers having voltage buffer regions for buffering effects resulting from a high voltage, said drivers being serially connected in a one-to-one ratio to, and unitized with, the drive elements, and being arranged at a pitch enlarged by at least the voltage buffer region portions with respect to the pitch of the drive elements, and driving the drive elements.

In this configuration, liquid discharge ports that discharge liquid are arranged at a pitch corresponding to a resolution and plural drive elements for causing the liquid to be discharged from the liquid discharge ports in correspondence to the liquid discharge ports are arranged at a pitch corresponding to the resolution. The drive elements are driven by plural drivers that include voltage buffer regions for buffering effects resulting from a high voltage, are serially connected in a one-to-one ratio to, and unitized with, the drive elements, and are arranged at a pitch enlarged by at least the voltage buffer region portions with respect to the pitch of the drive elements. Note that "effects resulting from a high voltage" indicates a phenomena such that the liquid cannot be discharged from the discharge port because, due to the increment of the strength in the electric field caused by high voltage, electrons accelerate and destroy the driver structure, and current leaks therefrom. Further, the "regions for buffering effects resulting from a high voltage" indicate regions within the driver, in which the diffusion level of the impurities that generate the electrons mentioned above is low, so as to decrease the electrons that are accelerated by the high voltage.

As the drive elements, heaters, piezo elements, and MEMS (Micro Electrical Mechanical Systems) drive elements such as solenoids and cantilevers can be applied. As the drivers, switching elements such as transistors can be applied.

Namely, the pitch of the drivers is enlarged by at least the voltage buffer region portions with respect to the pitch of the drive elements. For this reason, drivers disposed with voltage buffer regions for buffering effects resulting from a high voltage are applied as the drivers of the drive elements. Thus, the voltage applied to the recording head can be increased and the drive current can be lowered.

Also, effects resulting from differences in the wiring resistances between units configured by the drive elements and the drivers are alleviated by increasing the voltage applied to the recording head.

In this manner, in a recording head configured by liquid discharge ports that discharge liquid being arranged at a pitch corresponding to a resolution and plural drive elements for causing the liquid to be discharged from the liquid discharge ports in correspondence to the liquid discharge ports being arranged at a pitch corresponding to the resolution, plural drivers are disposed which include voltage buffer regions for buffering effects resulting a high voltage, are serially connected in a one-to-one ratio to, and unitized with, the drive elements, are arranged at a pitch enlarged by at least the voltage buffer region portions with respect to the pitch of the drive elements, and drive the drive elements. Thus, image recording can be conducted at a high speed while alleviating effects resulting from differences in wiring resistances between the units configured by the drive elements and the drivers and lowering the drive current.

A second aspect of the invention provides a method of forming a recording head including the liquid discharge ports that discharge liquid being arranged at a pitch corresponding to a resolution, the plural drive elements for causing the liquid to be discharged from the liquid discharge ports in correspondence to the liquid discharge ports being arranged at a pitch corresponding to the resolution, the plural drivers that drive the drive elements and include voltage buffer regions for buffering effects resulting a high voltage, wherein the method including: determining a disposed pitch Ph of the drive elements; determining a disposed pitch Pd of the drivers to satisfy a relationship where Ph<Pd; disposing the drive elements and the drivers so that an arrangement direction of the drive elements and an arrangement direction of the drivers are congruous on a substrate; connecting the drive elements in parallel with a first line; and serially connecting the drive elements and the corresponding drivers with second lines.

BRIEF DESCRIPTION OF THE DRAWINGS

An embodiment of the invention will be described in detail on the basis of the following figures, wherein.

DETAILED DESCRIPTION OF THE INVENTION

Figure 1:
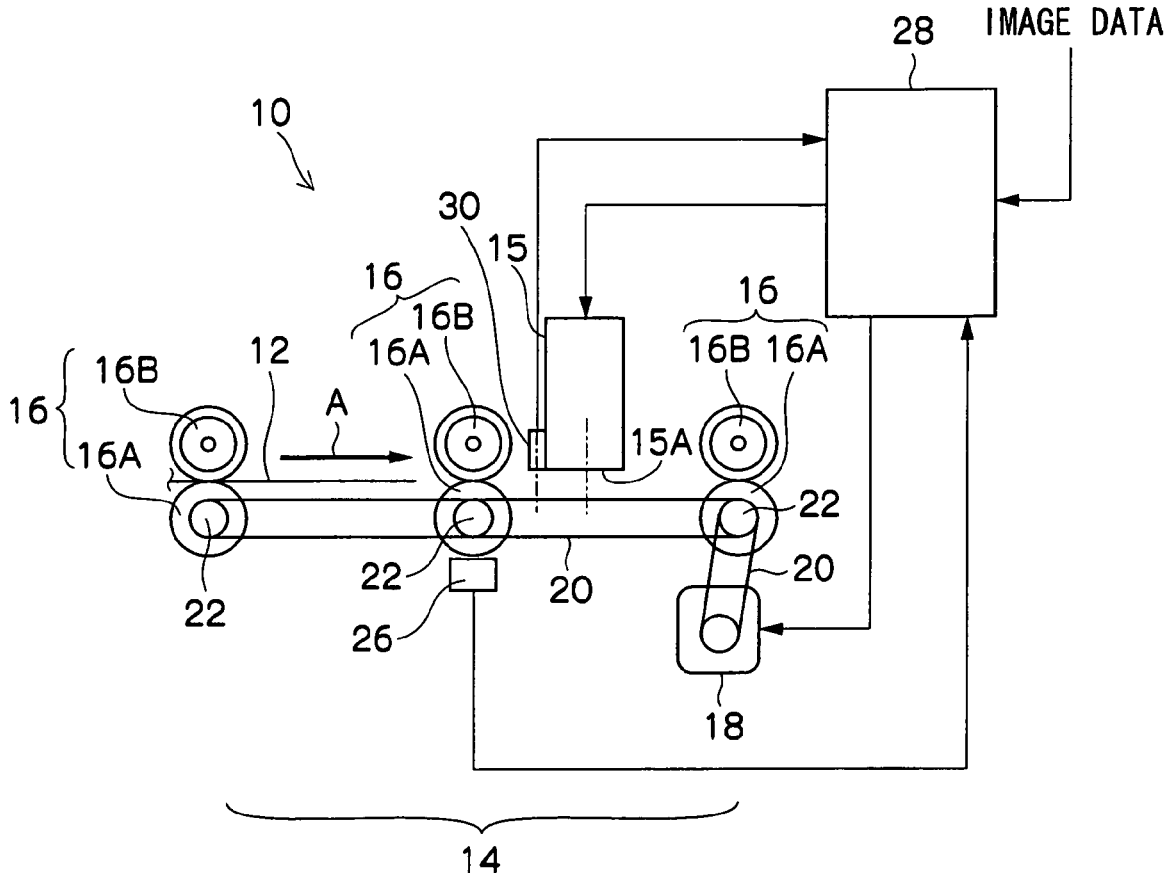
FIG. 1 is a schematic configural diagram of a printer pertaining to an embodiment of the invention.

FIG. 1 is a schematic configural diagram showing an inkjet printer 10 (referred to below simply as "the printer 10") serving as an image recording device pertaining to an embodiment of the invention.

The printer 10 is configured by a conveyance system 14, which flatly and horizontally conveys recording paper 12, and a recording head 15, which is disposed in the middle of a conveyance path along which the recording paper 12 is conveyed by the conveyance system 14.

Figure 2:
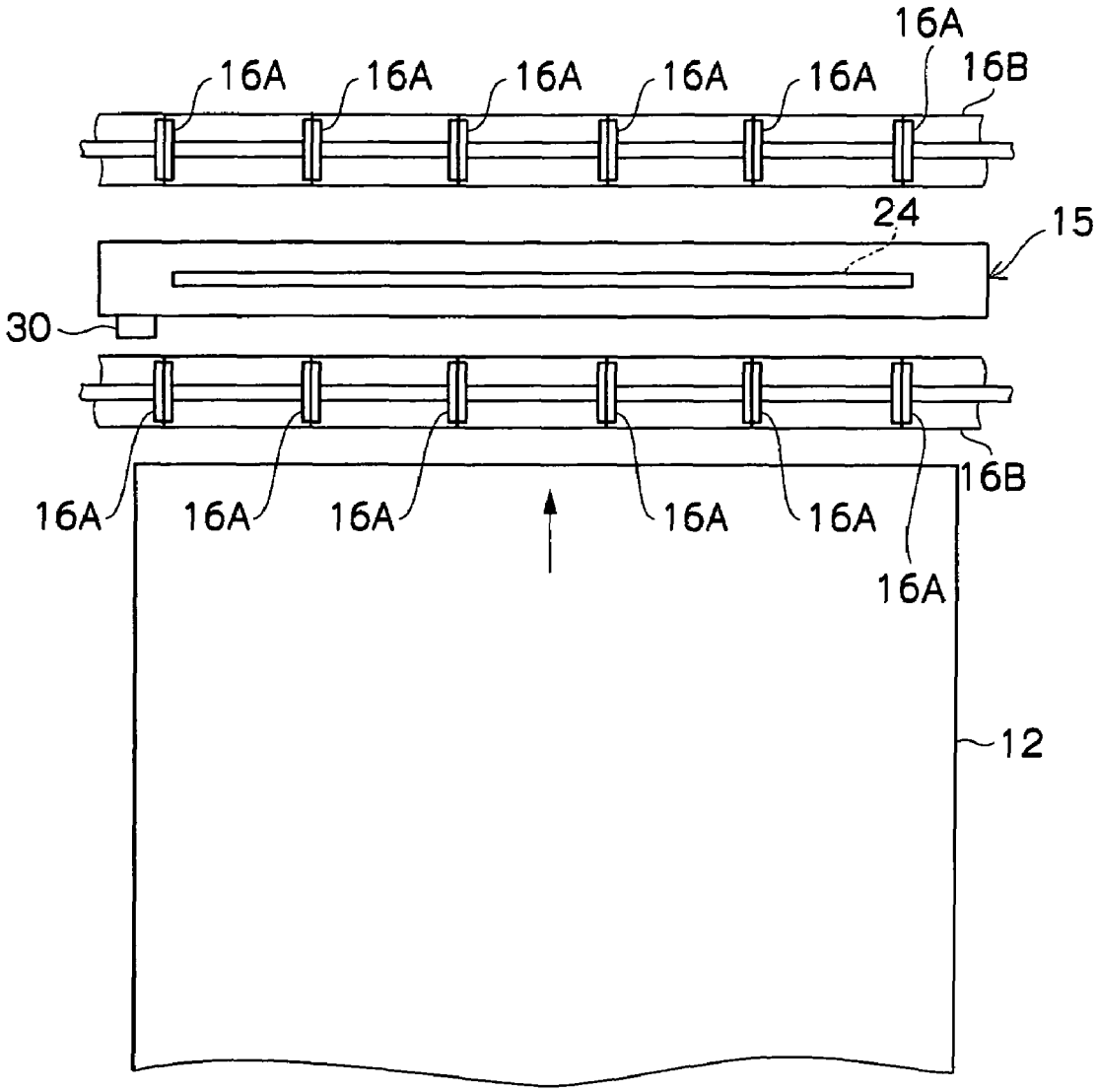
FIG. 2 is a plan view of the printer of FIG. 1.

The conveyance system 14 is disposed with plural conveyance roller pairs 16. Each of the conveyance roller pairs 16 is configured by a drive roller 16A and a driven roller 16B. The drive rollers 16A support the recording paper 12. The driving force of a motor 18 is applied via sprockets 22 to rotatingly drive the driver rollers 16A. The driven rollers 16B are disposed facing the drive rollers 16A and hold down the upper surface of the recording medium 12 supported by the drive rollers 16A. The rollers 16A and 16B are intermittently disposed (in a skewered manner) in the direction intersecting the conveyance direction of the recording paper 12 (see FIG. 2).

When the recording paper 12 is loaded at a predetermined position by an unillustrated sheet feeder or the like so that a recording surface of the recording paper 12 faces upward, the recording paper 12 is conveyed substantially horizontally in the direction of arrow A in FIG. 1.

The recording surface of the recording paper 12 conveyed by the conveyance system 14 passes underneath the recording head 15.

The undersurface of the recording head 15 facing the recording paper 12 includes a nozzle surface 15A. The recording head is configured to record an image on the recording paper 12 by discharging ink from the nozzle surface 15A towards the recording paper 12.

Figure 3A:
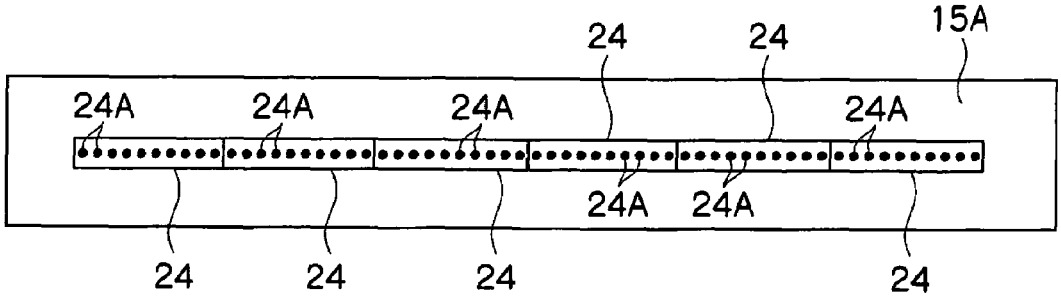
FIG. 3A shows the configuration of a nozzle surface of a recording head pertaining to the embodiment of the invention, and shows an arrangement pattern where nozzle units are arranged in one row.

As shown in FIG. 3A, the simplest configuration is one where nozzle units 24, in which plural nozzles 24A (in FIG. 3A, drawn-out lines are partially shown) are arranged in one row, are arranged in one row in the nozzles surface 15A in the longitudinal direction of the recording head 15 (i.e., the direction intersecting the conveyance direction of the recording paper 12).

Figure 3B:
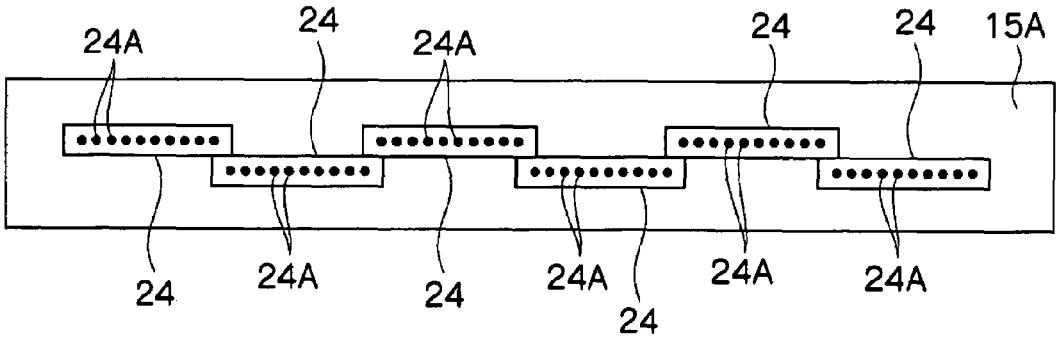
FIG. 3B shows the configuration of a nozzle surface of a recording head pertaining to the embodiment of the invention, and shows an arrangement pattern where nozzle units are staggered.

When the nozzles 24A are not present at a uniform pitch at both longitudinal-direction end portions of the nozzle units 24, it is also possible to dispose the nozzles units 24 in a staggered manner as shown in FIG. 3B.

As shown in FIG. 1, a pulse encoder 26 is attached to the drive roller 16A closest to the recording head 15 of the conveyance roller pairs 16 configuring the conveyance system 14.

The pulse encoder 26 is configured by a circular plate, which rotates in accompaniment with the rotation of a driven body (here, the drive roller 16A) and in which plural slits (or black/white alternating patterns) of an equal pitch are disposed across the entire peripheral edge, and a sensor portion that detects the transmittance/non-transmittance (or black/white) of the slit portions of the circular plate. In FIG. 1, the representation of the pulse encoder 26 has been simplified with a block diagram-like rectangle.

The sensor portion of the pulse encoder 26 outputs a rectangular wave in response to the rotation of the drive roller 16A. The rectangular wave is inputted to a controller 28. The controller 28 conducts control to maintain constant speed conveyance of the recording paper 12, such as feedback-controlling the rotational speed of the motor 18, on the basis of the rectangular wave.

The rectangular wave from the pulse encoder 26 is applied as a timing signal of later-described lines at the time of image recording. Namely, because the rectangular wave from the pulse encoder 26 (referred to below as a "printing clock") faithfully reproduces the conveyance state of the recording paper 12, even if a change arises in the speed at which the recording paper 12 is conveyed by the conveyance system 14, image recording is conducted on the basis of the printing clock, whereby unevenness in the line pitch can be controlled.

As shown in FIG. 1, a leading end detection sensor 30 that detects the leading end of the recording paper 12 is attached to the recording head 15. The leading end detection sensor 30 outputs a high-level signal when the recording paper 12 is not present and outputs a low-level signal when the recording paper 12 is present. The leading end detection sensor 30 is connected to the controller 28 and transmits the high-level signal or the low-level signal to the controller 28.

Thus, when the recording paper 12 is conveyed by the conveyance system 14 and the leading end of the recording paper 12 reaches a detection position of the leading end detection sensor 30, the signal of the leading end detection sensor 30 is inverted (changed from a high level to a low level), so that the controller 28 can recognize the arrival of the recording paper 12 at the recording head 15.

Image data are inputted to the controller 28. Ink is jetted from the nozzle surface 15A at a predetermined timing on the basis of the image data to record an image.

Namely, the leading end detection signal (the period when the signal is inverted from a high level to a low level) from the leading end detection sensor 30 triggers the start of image recording on the basis of the pitch dimension between the detection position of the leading end detection sensor 30 and the recording head 15 (actually the axial centers of the nozzles 24A), the speed at which the recording paper 12 is conveyed by the conveyance system 14 and the printing clock from the pulse encoder 26.

Figure 4:
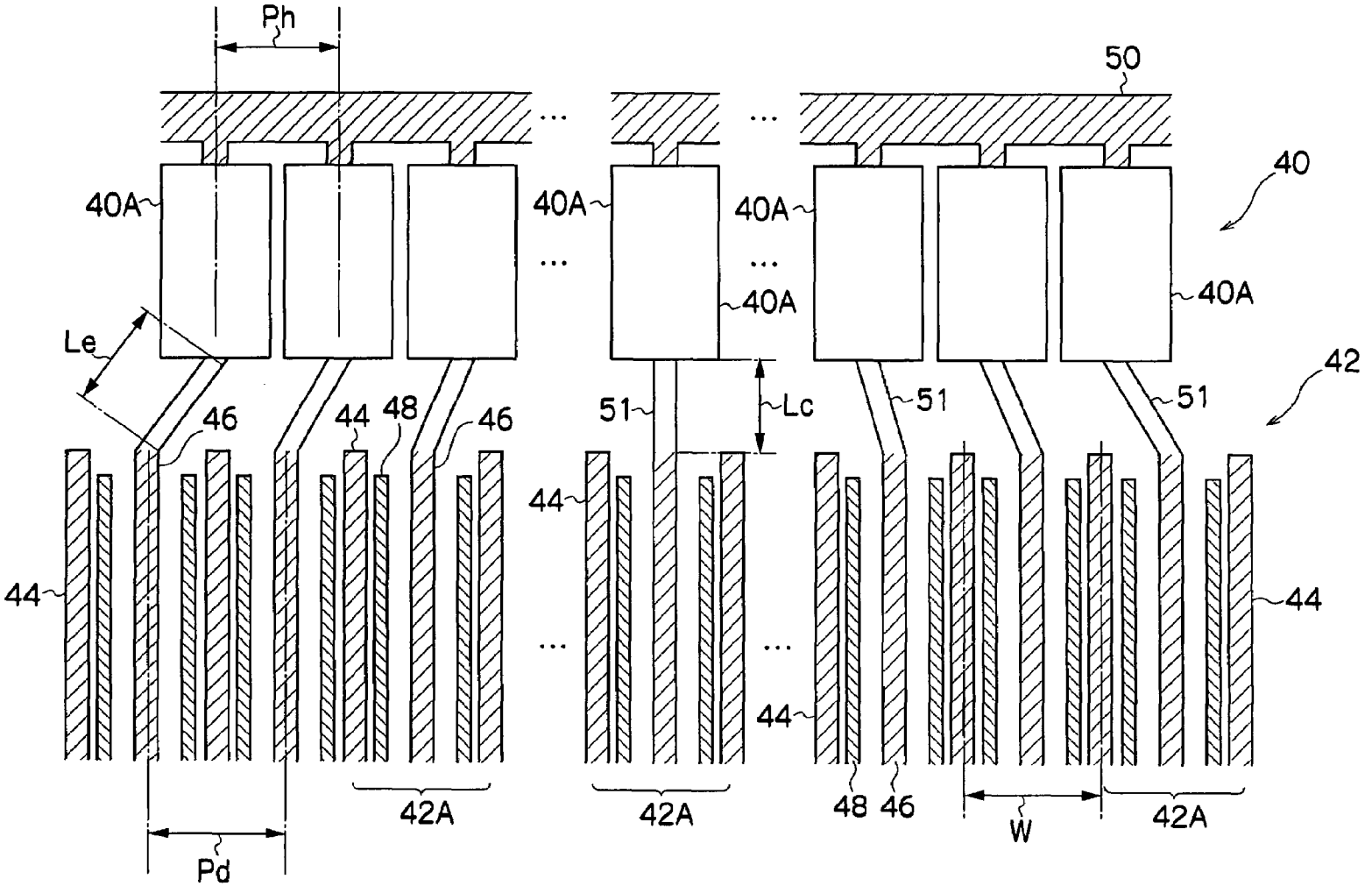
FIG. 4 is a schematic diagram showing the arrangement of heaters and driver transistors that drive the heaters of the recording head pertaining to the embodiment of the invention.

As shown in FIG. 4, the recording head 15 is configured to include a heater section 40 and a driver section 42. In the heater section 40, heaters 40A that heat ink and cause the ink to be discharged are disposed at a predetermined pitch Ph with respect to the nozzles 24A. In the driver section 42, plural driver transistors 42A that are formed on a substrate 38 (not shown in FIG. 4; see FIG. 5) and drive the heaters 40A are disposed at a predetermined pitch Pd. The pitch Ph of the heater section 40 is less than the pitch Pd of the driver section 42 (Ph<Pd), but the details of this relationship will be described later.

The pitch Ph of the heater section 40 and the number of heaters 40A configuring the heater section 40 are dependent on the resolution of the printer 10. The heaters 40A are disposed at positions corresponding to the nozzles 24A disposed at positions corresponding to the resolution of the printer 10.

Assuming that the resolution of the printer 10 is 800 dpi, 800 of the nozzles 24A are disposed per inch in the recording head 15. For this reason, 800 of the heaters 40A are disposed per inch. Also, the number of driver transistors 42A disposed in the recording head 15 is the same as the number of nozzles 24A and the number of heaters 40A. However, because the pitch Ph is less than the pitch Pd, the number of driver transistors 42A per inch is less than 800.

One end of each heater 40A is connected in parallel to a line 50 whose voltage is 40 V. The other end of each heater 40A is connected to a drain electrode 46 of the corresponding driver transistor 42A via a line 51 whose film thickness and material are the same as those of the line 50. Source electrodes 44 of the driver transistors 42A are grounded, and gate electrodes 48 are connected to an unillustrated control circuit. When a voltage is applied to the gate electrodes 48, the driver transistors 42A are switched ON to drive the heaters 40A.

Figure 5:
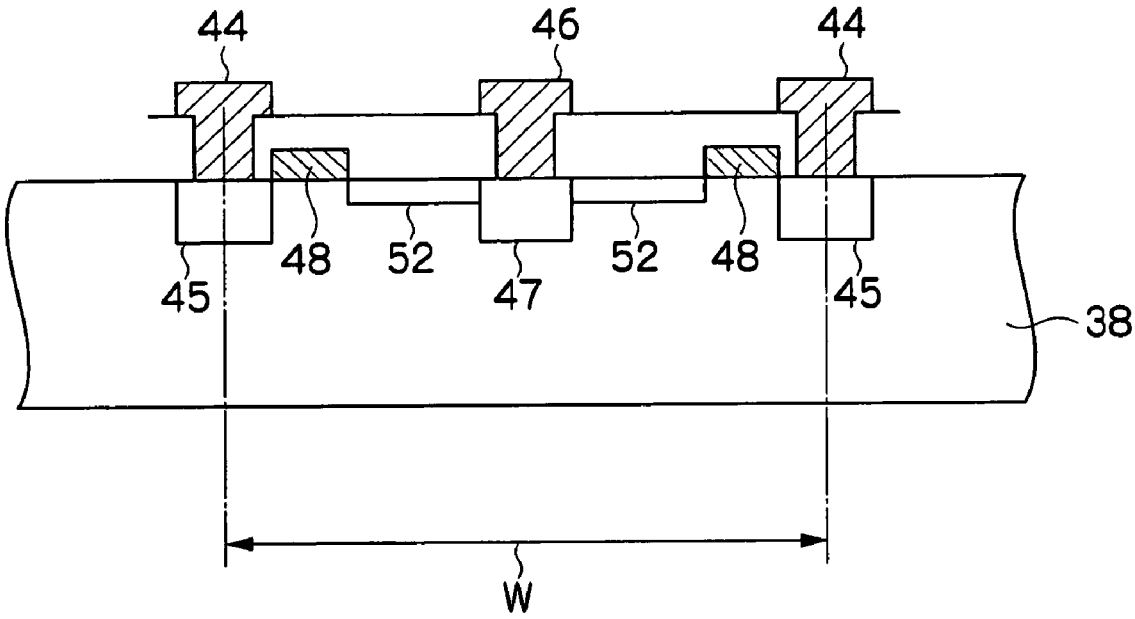
FIG. 5 is a cross-sectional diagram of the driver transistors of FIG. 4.
Figure 6A:
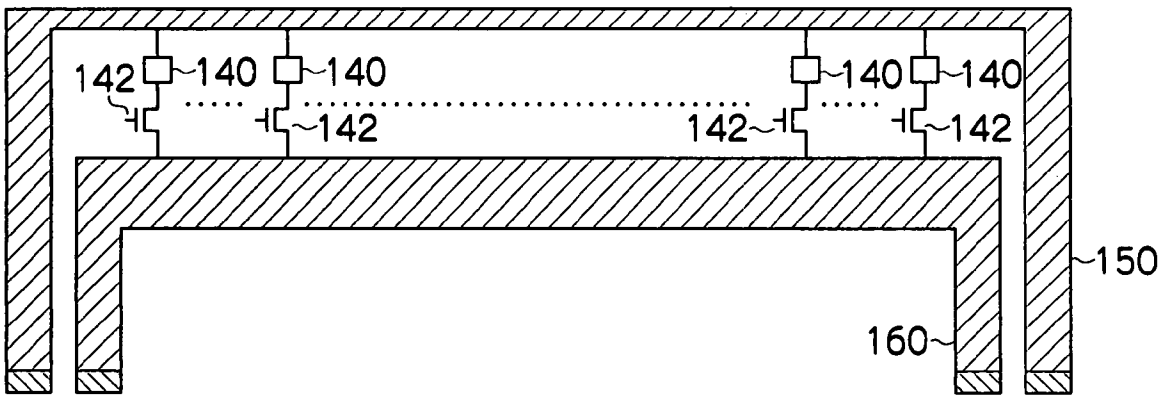
FIG.6A PRIOR ART
FIG. 6A is a schematic diagram showing the wiring of heaters and driver transistors that drive the heaters of a conventional recording head.
Figure 6B:
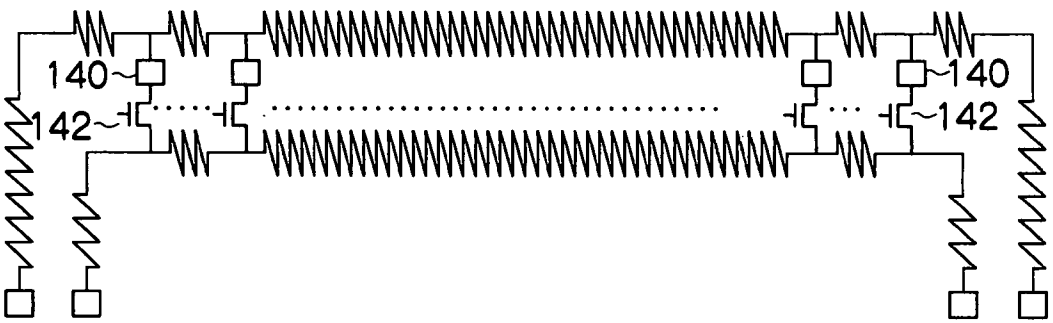
FIG.6B PRIOR ART
FIG. 6B is a schematic diagram showing an equivalent circuit of FIG. 6A.
Figure 7:
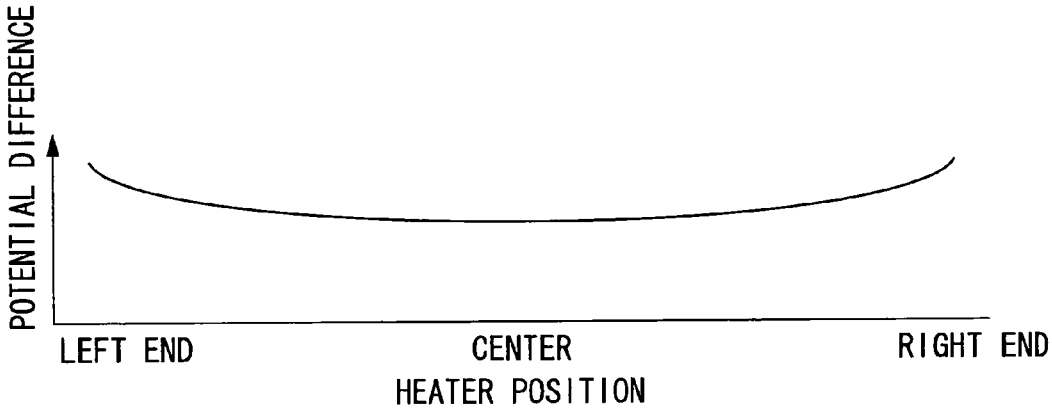
FIG.7 PRIOR ART
FIG. 7 is a diagram showing the relationship between connection positions of heaters and potential difference of both ends of heaters when the wiring of FIG. 6A is applied.

FIG. 5 is a cross-sectional diagram showing the drive transistor 42A pertaining to the present embodiment. As shown in FIG. 5, the source electrodes 44, the drain electrode 46 and the gate electrodes 48 are formed on the substrate 38. Source diffusion layers 45 are formed below the source electrodes 44, and a drain diffusion layer 47 is formed below the drain electrode 46. Voltage buffer regions 52 that have the function of buffering the effects of voltage are disposed between the drain diffusion layer 47 and the gate electrodes 48.

In the present embodiment, as shown in FIG. 5, a size W of each driver transistor 42A (length in the left-right direction of FIGS. 4 and 5) is larger than the pitch Ph of the heaters 40A. For this reason, the disposed pitch Pd of the driver transistors 42A is larger than the disposed pitch of the heaters 40A (Ph<Pd).

Namely, because the voltage buffer regions 52 are disposed in the driver transistors 42A, the size W of each driver transistor 42A is enlarged by that much. However, in the present embodiment, because the voltage buffer regions 52 are disposed only between the drain diffusion layer 47 and the gate electrodes 48, the enlargement of the size W of each driver transistor 42A is suppressed to a necessary minimum.

Also, in the present embodiment, a wiring length Lc between the heater 40A positioned in the center of the heater section 40 and the driver transistor 42A corresponding to that heater 40A and positioned in the center of the driver section 42 is the shortest, and the wiring length between the heaters 40A and the corresponding driver transistors 42A becomes longer towards the heaters 40A positioned at both ends of the heater section 40. Therefore, a wiring length Le of the heaters 40A positioned at both ends is the longest. The wiring length effects the resistance (wiring resistance) arising when a drive voltage is applied, and the wiring resistance becomes larger the longer the wiring length becomes.

With respect to this, as shown in FIG. 4, the wiring length of the positive side (line 50) of the heaters 40A becomes shorter towards both ends in the arrangement direction of the units and shortest at the center, in contrast to the wiring lengths of the lines 51.

Thus, in consideration of the relationship between the wiring length and the wiring resistance, the wiring length of the positive side and the wiring length of the negative side of the heaters 40A are adjusted as described above, and variations in the wiring resistances between each unit configured by the heaters 40 and the driver transistors 42A offset each other.

Next, the action of the present embodiment will be described. First, the overall operation of the printer 10 pertaining to the present embodiment will be described.

In the printer 10, image data are inputted to the controller 28. When an instruction for image recording is inputted, the controller 28 controls the unillustrated sheet feeder or the like to load the recording paper 12 at the predetermined position so that the recording surface of the recording paper 12 faces up.

When the recording paper 12 is loaded at the predetermined position, the recording paper 12 is conveyed substantially horizontally in the direction of arrow A in FIG. 1 by the conveyance system 14.

When the leading end of the recording paper 12 conveyed by the conveyance system 14 is detected by the leading end detection sensor 30, the output signal of the leading end detection sensor 30 is inverted from a high level to a low level, and the controller 28 determines that the recording paper 12 has reached the vicinity of the recording head 15 and starts image recording on the recording paper 12 with the recording head 15.

Namely, the controller 28 executes image recording by controlling the recording head 15 at a timing synchronized with the printing clock inputted from the pulse encoder 26 and causing ink corresponding to the image represented by the image data to be discharged from the nozzle surface 15A onto the recording surface of the recording paper 12 passing below the recording head 15.

Next, the layout sequence of the heater section 40 and the driver section 42 of the recording head 15 pertaining to the present embodiment will be described.

First, the disposed pitch Ph of the heaters 40A configuring the heater section 40 is determined. Because the heaters 40A are disposed in a one-to-one correspondence with the nozzles 24A disposed in the recording head 15, it is necessary for the intervals between adjacent heaters 40A to be equal and for the pitch Ph to be such that the density corresponds to the resolution. The number of heaters 40A is determined in accordance with the resolution of the printer 10. For example, if the resolution of the printer 10 is 800 dpi, 800 of the heaters 40A are disposed per inch in the recording head 15.

Next, the disposed pitch Pd of the driver section 42 for driving the heaters 40A is determined. Driver transistors 42A of the same number as the number of heaters 40A configuring the heater section 40 are disposed in the driver unit 42 at a pitch Pd such that the intervals between adjacent driver transistors 42A are equal. The pitch Pd is determined by the size of the driver transistors 42A and is greater than the pitch Ph of the heater unit 40.

Namely, in the present embodiment, adjacent driver transistors 42A share source electrodes 44. For this reason, the pitch Pd of the driver section 42 is determined by the size W of each driver transistor 42A.

Also, as described above, the driver transistors 42A of the present embodiment are configured to include the voltage buffer regions 52, and the size W of a single drive transistor 42A is greater than the pitch Ph of the heater section 40.

After the pitch Ph of the heater section 40 and the pitch Pd of the driver section 40 have been determined in this manner, the disposition of the heater section 40 and the driver section 42 is determined.

The heater section 40 and the driver section 42 are disposed so that the arrangement direction of the heaters 40A and the arrangement direction of the driver transistors 42A are congruous on the substrate and so that the unit configured by the heater 40A positioned in the center of the heater section 40 and the driver transistor 42A positioned in the center of the driver section 42 is positioned in the center of the arrangement direction.

Then, wiring is done so that the heaters 40A are connected in parallel by the line 50 (first line), and wiring is done so that a voltage of 40 V is applicable to both ends of the line 50.

Wiring is also done so that the heaters 40A and the corresponding driver transistors 42A are serially connected by the lines 51 (second lines). At this time, as described above, the pitch Pd of the driver section 42 is greater than the pitch Ph of the heater section 40. For this reason, the line 51 connecting the heater 40A in the center of the heater section 40 and the driver transistor 42A in the center of the driver section 42 is orthogonal, on the substrate surface, to the arrangement direction of the heater section 40 and the driver section 42, and the angle formed by the line 51 and the arrangement direction on the substrate is greater the further the line 51 is toward either of the lines 51 connecting the heaters 40A and the driver transistors 42A positioned at both ends. Thus, the wiring length of the lines 51 becomes longer towards both ends in the arrangement direction. Wirings connect the negative terminals of the heaters 40A to the drain electrodes 46 of the corresponding driver terminals 42A.

Moreover, wiring is done so that the source electrodes 44 of the driver transistors 42A are grounded and so that the gate electrodes 48 are connected to the unillustrated control circuit that applied a predetermined voltage at a predetermined timing under the control of the controller 28.

Here, at the time the recording head 15 is driven, wiring resistance corresponding to the wiring length arises in the line 50 and the lines 51. When there is a difference in wiring resistances between units configured by the heater and driver transistor pairs, the recording head must be controlled in consideration of the difference in wiring resistance for each unit, and the control becomes cumbersome. The wiring resistance becomes greater the longer the wiring length is.

In the present embodiment, the wiring length between each heater 40A and the end portions of the line 50 to which the voltage is applied becomes shorter towards the heaters 40A connected to both ends of the line 50 and becomes longer towards the heater 40A connected to the center of the line 50. Thus, the wiring resistance is greatest at the heater 40A in the center of the heater section 40 and as small as the heaters 40A at both ends.

As described above, the angle of the corner formed between the arrangement direction and the lines 51 are as large as the units at both ends, and the line 51 diagonally connects the heaters 40A and the driver transistors 42A. For this reason, the wiring length of the lines 51 becomes longer towards the units at both ends, and a large wiring resistance arises.

Thus, the differences in the wiring resistances of the line 50 arising between units are cancelled out by the differences in the wiring resistances of the lines 51 arising between the units, so that overall the recording head can be handled as a recording head in which there are no differences in the wiring resistances between the units.

The wiring length of the line 50 can be adjusted by adjusting the distance between the heater section 40 and the driver section 42.

As described in detail above, in the present embodiment, in the recording head 15 configured by the nozzles 24A that discharge the ink being arranged at a pitch corresponding to a resolution and the plural heaters 40A for causing the ink to be discharged from the nozzles 24A in correspondence to the nozzles 24A being arranged at the pitch Ph corresponding to that resolution, the plural driver transistors 42A are disposed which include the voltage buffer regions 52 for buffering effects resulting from a high voltage, are serially connected in a one-to-one ratio to, and unitized with, the heaters 40A, are arranged at the pitch Pd where at least the voltage buffer regions 52 are enlarged with respect to the pitch of the heaters 40A, and drive the heaters 40A. Thus, image recording can be conducted at a high speed while reducing the effects resulting from the wiring resistances between the units configured by the heaters 40A and the driver transistors 42A and lowering the drive current.

In the present embodiment, the units configured by the heaters 40A and the driver transistors 42A are connected in parallel to the line 50 to which the drive voltage is applied, and the wiring length of the lines 51 that serially connect the heaters 40A and the driver transistors 42A is equivalent to a length that cancel out the wiring resistance differences between the units configured by the heaters 40A and the driver transistors 42A. Therefore, the wiring length between the heaters 40A and the driver transistors 42A where the wiring resistance is the greatest is made the shortest in accordance with the position of the line 50 to which the voltage is applied and the positions where the heaters 40A are connected, and the wiring length between the heaters 40A and the driver transistors 42A is lengthened as the wiring resistance becomes smaller, whereby the wiring resistance differences between the units can be cancelled out, and image recording can be conducted at a high speed while reducing the effects resulting from the differences in the wiring resistances between the units configured by the heaters 40A and the driver transistors 42A and lowering the drive current.

More specifically, the units configured by the heaters 40A and the driver transistors 42A are connected in parallel to the line 50 to which the drive voltage is applied from both ends in the unit arrangement direction, and the wiring length of the lines 51 serially connecting the heaters 40A and the driver transistors 42A is made the shortest at the center of the unit arrangement direction (Lc) and the longest at both ends (maximum at both ends (Le)).

In the present embodiment, an embodiment was described where a recording head that discharges ink using a thermal inkjet format was applied as the recording head 15, but the invention is not limited to this.

Namely, as long as the recording head 15 is an inkjet recording head that can discharge the ink from the nozzle surface 15A, any type of ink and any type of ink discharge format can be used. Additionally, a piezo inkjet recording head, a continuous flow inkjet recording head, or an electrostatic suction inkjet recording head can be applied. Moreover, with respect to the ink that is used, a water-based ink, an oil-based ink, a solid ink, or a solvent ink are applicable. The color material in the ink may be a pigment or dye.

The above embodiment was configured so that the differences in the wiring resistances between the units were cancelled out by adjusting the wiring length of the conductors of the drivers and the drive elements, but the invention may also be configured so that the differences in the wiring resistances are cancelled out by the width of the wiring pattern or a combination of the width and length of the wiring pattern rather than just the length.

As described above, in a recording head configured by ink discharge ports that discharge ink being arranged at a pitch corresponding to a resolution and plural drive elements for causing the ink to be discharged from the ink discharge ports in correspondence to the ink discharge ports being arranged at a pitch corresponding to the resolution, plural drivers are disposed which include voltage buffer regions for buffering effects resulting a high voltage, are serially connected in a one-to-one ratio to, and unitized with, the drive elements, are arranged at a pitch enlarged by at least the voltage buffer region portions with respect to the pitch of the drive elements, and drive the drive elements. Thus, the invention has the excellent effect that image recording can be conducted at a high speed while alleviating effects resulting from differences in wiring resistances between the units configured by the drive elements and the drivers and lowering the drive current.

Also, by making the wiring length between the drive elements and the drivers where the wiring resistance is the greatest to be shortest and making the wiring length between the drive elements and the drivers to be longest as the wiring resistance becomes smaller in accordance with positions where the voltage is applied and positions where the drive elements are connected, the wiring resistance differences between the units can be cancelled out, and image recording can be conducted at a high speed while alleviating effects resulting from differences in wiring resistances between the units configured by the drive elements and the drivers and lowering the drive current.

Moreover, the units including the drive elements and the drivers are connected in parallel to a conductor to which a drive voltage is applied from both ends in a unit arrangement direction, and the wiring length of conductors serially connecting the drive elements and the drivers is shortest at the center of the unit arrangement direction and longest at both ends. Thus, wiring resistance differences between the units can be cancelled out.

Moreover, by disposing an image recording device with the recording head of the invention, image recording can be conducted at a high speed while alleviating effects resulting from differences in wiring resistances between the units including the drive elements and the drivers and lowering the drive current.

What is claimed is:

1. A recording head comprising:

liquid discharge ports that discharge liquid and are arranged at a pitch corresponding to a resolution, wherein said liquid comprising an ink;

plural drive elements that cause the liquid to be discharged from the liquid discharge ports in correspondence to the liquid discharge ports and are arranged at a pitch corresponding to the resolution; and plural drivers having voltage buffer regions for buffering effects resulting from a high voltage, said drivers being serially connected in a one-to-one ratio to, and unitized with, the drive elements, and being arranged at a pitch enlarged by at least the voltage buffer region portions with respect to the pitch of the drive elements, and driving the drive elements as respective units.

2. The recording head of claim 1, wherein the units comprising the drive elements and the drivers are connected in parallel to a conductor to which a drive voltage is applied, and conductors serially connecting the drive elements and the drivers are wired to cancel out wiring resistance differences between the units.

3. The recording head of claim 2, wherein the wiring resistance differences between the units are cancelled out by adjusting the width of the conductors serially connecting the drive elements and the drivers.

4. The recording head of claim 2, wherein the wiring resistance differences between the units are cancelled out by adjusting the width and length of the conductors serially connecting the drive elements and the drivers.

5. The recording head of claim 1, wherein the units comprising the drive elements and the drivers are connected in parallel to a conductor to which a drive voltage is applied from both ends in a unit arrangement direction, and the wiring resistance differences between the units are cancelled out by making the wiring length of conductors that serially connect the drive elements and the drivers the shortest at the center of the unit arrangement direction and the longest at both ends.

6. The recording head of claim 1, wherein the drive elements comprise heaters.

7. The recording head of claim 1, wherein the drivers comprise transistors.

8. The recording head of claim 1, wherein the drivers comprise source diffusion layers and drain diffusion layers, the voltage buffer region portions being disposed between the source diffusion layers and the drain diffusion layers.

9. An image recording device having a recording head, wherein the recording head comprises:

liquid discharge ports that discharge liquid and are arranged at a pitch corresponding to a resolution, wherein said liquid comprising an ink;

plural drive elements that cause the liquid to be discharged from the liquid discharge ports in correspondence to the liquid discharge ports and are arranged at a pitch corresponding to the resolution; and plural drivers having voltage buffer regions for buffering effects resulting from a high voltage, said drivers being serially connected in a one-to-one ratio to, and unitized with, the drive elements, and being arranged at a pitch enlarged by at least the voltage buffer region portions with respect to the pitch of the drive elements, and driving the drive elements.

10. A method of forming a recording head comprising the liquid discharge ports that discharge liquid being arranged at a pitch corresponding to a resolution, the plural drive elements for causing the liquid to be discharged from the liquid discharge ports in correspondence to the liquid discharge ports being arranged at a pitch corresponding to the resolution, the plural drivers that drive the drive elements and include voltage buffer regions for buffering effects resulting a high voltage, wherein the method comprising:

determining a disposed pitch $P_h$ of the drive elements;

determining a disposed pitch $P_d$ of the drivers to satisfy a relationship where $P_h<P_d$;

disposing the drive elements and the drivers so that an arrangement direction of the drive elements and an arrangement direction of the drivers are congruous on a substrate;

connecting the drive elements in parallel with a first line; and serially connecting the drive elements and the corresponding drivers with second lines.

11. The recording head forming method of claim 10, wherein the disposed pitch $P_h$ of the drive elements is determined in accordance with the resolution.

12. The recording head forming method of claim 10, wherein a unit comprising the drive element positioned in a center of the drive elements and the driver positioned in a center of the drivers is disposed so that the unit is positioned in the center of an arrangement direction.

13. The recording head forming method of claim 10, wherein the widths of the second lines connecting the drive elements and the drivers are constant.

14. The recording head forming method of claim 13, wherein the lengths of the second lines at both ends in the arrangement direction of the drive elements and the drivers are longer than lengths of the second lines at the center of the arrangement direction.

15. The recording head forming method of claim 13, wherein, in the units comprising the drive elements and the drivers, the wiring resistance differences between the units are offset by adjusting the wiring lengths of the second lines by adjusting the distances between the drive elements and the drivers.

* * * * *